US007056386B2

(12) United States Patent
Pahl

(10) Patent No.: US 7,056,386 B2
(45) Date of Patent: Jun. 6, 2006

(54) DEVICE FOR SURFACE COATING OF VISCOSE MEDIA

(75) Inventor: Andreas Pahl, Erkrath (DE)

(73) Assignee: ITW Dynatec GmbH, Mettmann (DE)

( * ) Notice: Subject to any disclaimer, the term of this patent is extended or adjusted under 35 U.S.C. 154(b) by 0 days.

(21) Appl. No.: 10/840,424

(22) Filed: May 7, 2004

(65) Prior Publication Data

US 2005/0045095 A1 Mar. 3, 2005

(30) Foreign Application Priority Data

May 8, 2003 (DE) ..... 103 20 813

(51) Int. Cl.
*B05B 15/04* (2006.01)
*B05B 1/14* (2006.01)
*B05C 5/00* (2006.01)

(52) U.S. Cl. ..... 118/301; 118/325; 239/568; 239/553.5

(58) Field of Classification Search ..... 118/300, 118/301, 325, 411, 413, 416; 239/568, 553.5
See application file for complete search history.

(56) References Cited

U.S. PATENT DOCUMENTS 5,389,151 A * 2/1995 Fort ..... 118/411
5,478,224 A * 12/1995 McGuffey ..... 425/7
6,375,099 B1 * 4/2002 McGuffey ..... 239/553.5
6,866,209 B1 * 3/2005 Puffe ..... 239/568

FOREIGN PATENT DOCUMENTS

| | | |
|---|---|---|
| DE | 28 36 714 | 3/1979 |
| DE | 38 04 856 A1 | 8/1989 |
| EP | 1 166 890 A2 | 1/2002 |
| JP | 200070817 A | 3/2000 |

* cited by examiner

*Primary Examiner*—Chris Fiorilla
*Assistant Examiner*—Yewebdar Tadesse
(74) *Attorney, Agent, or Firm*—Lowe Hauptman & Berner, LLP

(57) ABSTRACT

A mechanism for the application of viscous substances, particularly of dispersion adhesives, onto a moving substrate, includes a jet body, upon which a variety of application modules are aligned, which are supplied with substances by means of at least one supply unit, and a slot jet configuration, with which the substance can be applied to the moving substrate in the form of a defined application pattern. The slot jet configuration may be exchanged for the purpose of altering the application pattern. The slot jet configuration is formed by a jet strip system, which is useable for any application pattern, and a distribution plate, which is replaceable regardless of application pattern and which is upstream of the jet strip system in terms of flow.

19 Claims, 6 Drawing Sheets

DEVICE FOR SURFACE COATING OF VISCOSE MEDIA

FIELD OF THE INVENTION

The invention concerns a mechanism for the area-measured application of viscous substances, particularly of dispersion adhesives, onto a moving substrate, consisting essentially of a jet body, upon which a variety of application modules are aligned, which are supplied with substances by means of at least one supply unit, and a slot jet configuration, with which the substance can be applied to the moving substrate in the form of a defined application pattern. The slot jet configuration may be exchanged for the purpose of altering the application pattern.

BACKGROUND OF THE INVENTION

Such a mechanism is, for example, already known from DE 38 04 856. This mechanism involves a flow of adhesive being allocated to various narrow slot jets, which is applied to the substrate according to a particular application pattern. This mechanism, which is advantageous in itself, has emerged as improvable with the realization that a complete replacement of several components of the existing slot jet configuration is necessary for a change in application pattern.

The background to this state of affairs is that all components in the slot jet configuration are on the one hand made out of very high quality and therefore expensive material, and that on the other hand not only the individual parts must be positioned exactly in line with one another when assembling the slot jet configuration, but that the contours must be slurred and polished with one another. Therefore the slot jet configuration has to be completely replaced whenever the application pattern is changed.

SUMMARY OF THE INVENTION

The aim of the invention involves creating a new mechanism for the area-measured application of viscous substances, whereby a change of application pattern can take place considerably faster and above all more cost-effectively.

According to the embodiments of the invention, the slot jet configuration is formed by a jet strip system, which is useable for any application pattern, and a distribution plate, which is replaceable regardless of application pattern and which is upstream of the jet strip system in terms of flow.

The basic advantage of the invention of this mechanism is the fact that when changing the application pattern, a faster and above all more cost-effective replacement of the distribution plate responsible for the changed application pattern is made possible. According to the invention the slot jet configuration is compartmentalized, whereby the jet strip system can be implemented as a bigger and above all very expensive part of the slot jet configuration, whilst changing the application pattern simply involves the considerably less expensive distribution plate needing to be replaced. The costs involved in the changing of the application pattern are therefore reduced considerably.

When implemented, the distribution plate is also, in contrast to the jet strip system, set at a distance to the movement path of the substrate. This leads to another considerable reduction of costs with the changing of the application pattern, as the distribution is set at a distance to the moving path of the substrate meaning that it no longer comes into contact with it, which in turn means that the distribution plate can be made out of considerably simpler and cheaper material.

With an advantageous implementation of the invention the jet strip system has a slotted plate provided with recesses facing the substrate upon which on the one side a conjoining plate facing the application module is aligned, which has notches corresponding to the recesses on it, whereby the recesses of the slotted plate on the other side are covered with the formation of the slot jets facing the substrate.

The slot jet configuration of the invention has the advantage of being replaceable as a unit when changing the application pattern as well as being able to make slot jets available in the desired areas by means of specially formed distribution plates.

Such a jet strip system can for example have the recesses aligned in the slotted plate, which are formed as recesses which stretch to the moving path of the substrate, which work together with the notches of a conjoining plate and the formation of a slot jet.

It is nevertheless also possible for recesses in the slotted plates on the side facing away from the conjoining plate to be covered by a front plate, so that slot jets are created in this manner.

BRIEF DESCRIPTION OF THE DRAWINGS

Further advantages of the invention arise in the following description. The figures show the following.

A mechanism for the area-measured application of viscose substances is indicated as whole in the illustrations with the cipher 10.

DETAILED DESCRIPTION OF THE INVENTION

Figure 1:
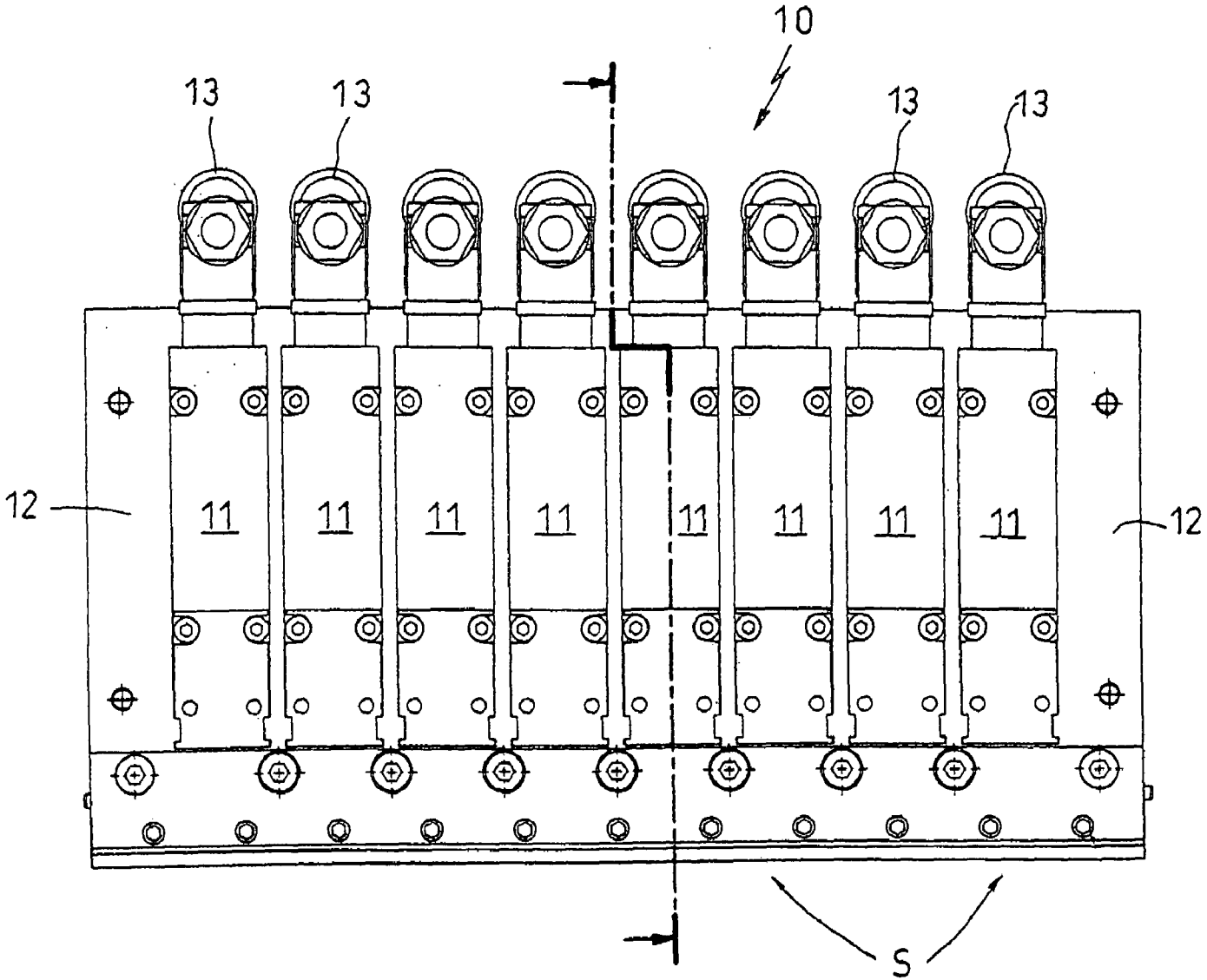
FIG. 1 A frontal view of mechanism for the area-measured application of viscose substances FIG. 2 A cross-sectional view of section boundary II—II in FIG. 1
Figure 2:
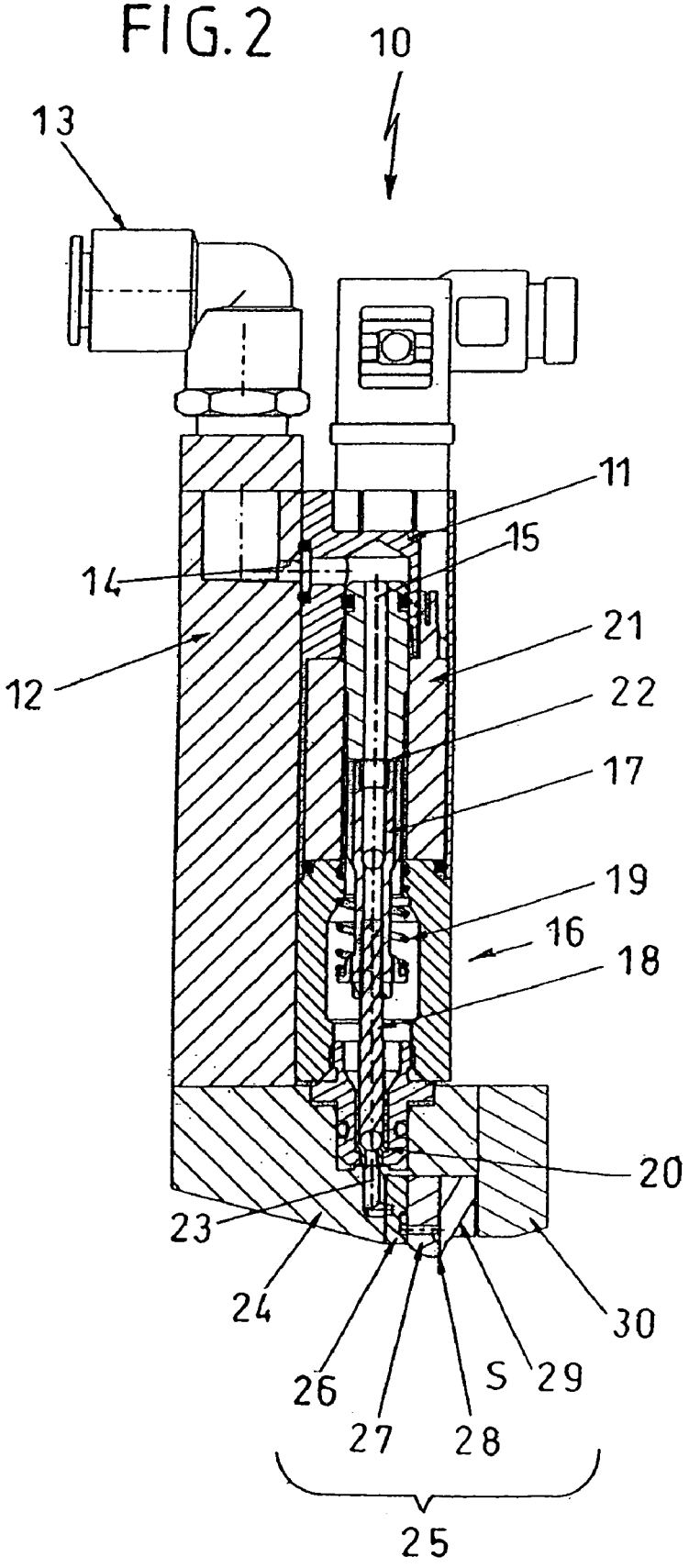

As shown in FIG. 1 and FIG. 2, the mechanism 10 exhibits eight application modules 11, which are each connected with a supply unit 12 and individual material attachments 13. In terms of concrete implementation this means that each application module 11 can be separately supplied with one or several different dispersion adhesives. It is also possible to supply individual application modules with dispersion adhesives at different pressure levels and therefore with different volume flows.

The material attachment 13 is—as can be seen in FIG. 2—connected via a distribution channel 14, which is aligned with the supply unit 12, to an application channel, which is aligned in an application module 11. In each application module 11 an outlet valve 16 is aligned with an outlet valve armature 17, which is connected to an outlet valve pin 18, which is pressed into the outlet valve seat 20 via a compression spring 19. In this position the outlet valve 16 is closed and the flow of material out off. The outlet valve annature 17 can, for example, be driven by a magnetic coil 21. If the outlet valve 16 is to be opened then the outlet valve armature 17 is raised to an impact ridge 22 with the help of the magnetic coil 21 working against the spring force of the compression spring 19, so tat a flow cross-section is available between the outlet valve pin 18 and the outlet valve 20. The substance can then flow via a channel 23 in a jet body 24 into a slot jet configuration 25, which will be illustrated and described in detail in the following pages.

Starting with the jet body 24, the slot jet configuration 25 is made up of a distribution plate 26, a conjoining plate 27, a slotted plate 28 and a front plate 29, whereby the parts named here are attachable by means of a pressure plate 30 on the jet body. These parts can be easily recognized in detail in the exploded view (see FIG. 3).

The distribution plate 26, which is immediately aligned with the jet body 24, exhibits the distribution notches 31, which show a form, which is concretely adjusted to the desired application pattern. The conjoining plate abuts onto the distribution plate, which has a row of notches 32 running along almost its entire width, whereby each individual notch is connected with a drill hole B on the opposite-lying surface of the conjoining plate 27. The distribution plate 26 with concretely formed and positioned distribution notches 31 cooperates with the conjoining plate 27 and the notch row 32 aligned in it according to assembly, to the extent that only very specific areas of the notch row 32 of the conjoining plate 27 are supplied with the substance from the specific application modules 11 via the distribution notches 31 in operation. This alignment makes it possible to supply specific areas (slot jet S) with varying levels of pressure and volume flow, with differing dispersion adhesives as well if necessary.

The slot jet configuration 25 then has the slotted plate 28, which is likewise provided with recesses along almost its entire width, which open downwards towards the moving path of the substrate. In addition, the front plate should also be pointed out, which in the illustrated implementation form exhibits a smooth surface facing towards the slotted plate 28, which covers the recesses 33 of the slotted plate 28 under formation of slot jet S.

For the purpose of a jet strip system D the conjoining plate 27, the slotted plate 28 and the front plate 29 are now positioned exactly with one another over the cylinder pivots 34 and connected. These three parts are then additionally attached to one another with the connecting screws 35, so that they are tightly connected to one another and shape the defined slot jet S. In this respect it should be emphasized that the cylinder pivots 34 facing the nozzle body 24 extend out of the jet strip system D, so that the distribution plate can be aligned here—this is important for the subsequent assembly.

Before a fastening of the jet strip system D and the distribution plate 26 onto the mechanism 10, the pressure plate 30 is fastened onto the mechanism 10 by means of the assembly screws 36, which fit into drill holes 37 of the jet body 24, in such a way that an assembly gap between the pressure plate 30 and the jet body 24 is available for the incorporation of the jet strip system D including the distribution plate 26. In the assembly of the jet plate D including the distribution plate 26 (slot jet configuration 25) the latter is inserted into the assembly gap and then tightly fastened by means of pressure screws 38 aligned in the pressure plate 30. The centering of the slot jet configuration 25 takes place here via the centering pivot Z (see FIG. 4).

Figure 3:
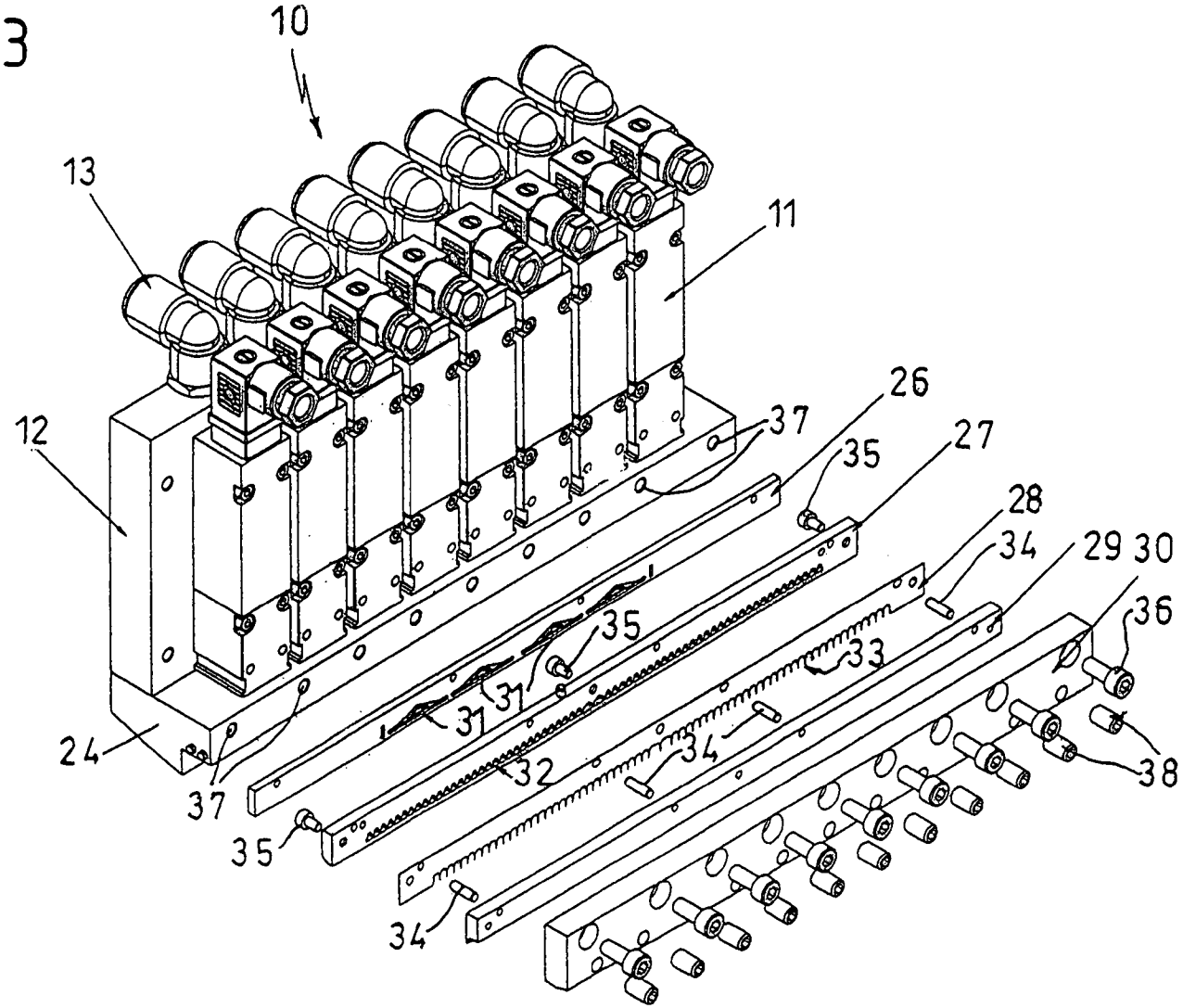
FIG. 3 A perspectival illustration of the mechanism shown in FIG. 1 in an exploded view FIG. 4 An exploded view of the slot jet configuration and FIG. 5 and FIG. 6 Depictions of various application patterns as well as the corresponding distribution plates.
Figure 4:
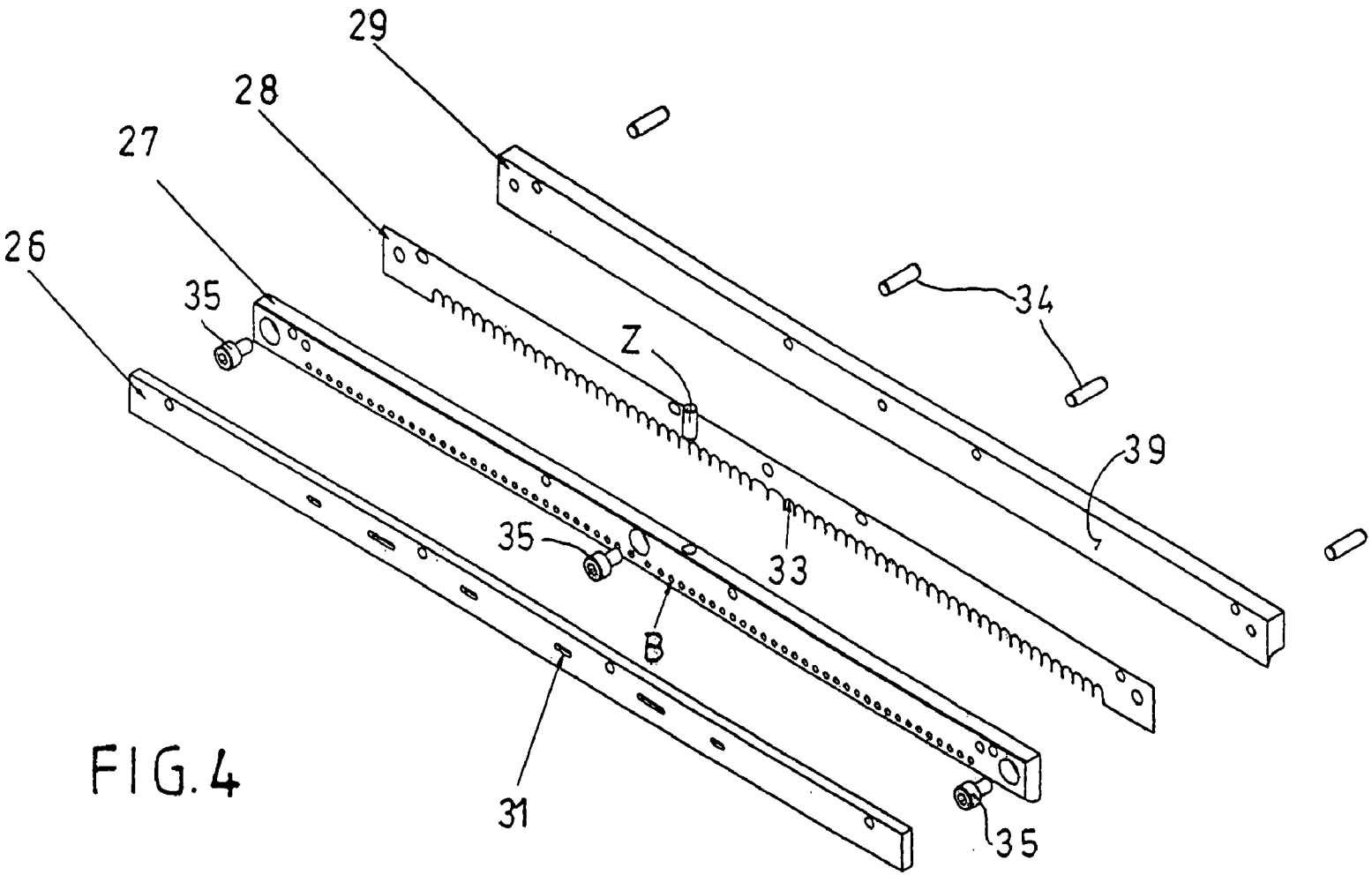

In FIG. 3 and FIG. 4, in which the individual parts of the slot jet configuration are illustrated from various different perspectives, it can be clearly seen how decisive the distribution plate 26 with its specialized alignment of the distribution notches 31 is for the forming of a concrete application pattern for the purpose of applying a substance to a substrate. According to the position of the distribution notches 31, specific drill holes B and therefore an area of the row of notches 32 of the conjoining plate 27 are supplied, whereby these are in turn aligned to the recesses which open towards the substrate, which after the connection of the conjoining plate 27, the slotted plate 28 and front plate 29 as the jet strip system D produce the slot jets S opening down towards the substrate, with which very specific areas of the substrate can be supplied with the desired substance.

It should be emphasized as a basic point that it would be on the one hand conceivable that the recesses 33 available in the slotted plate 28 are superfluous, so long as the row of notches 32 are also opened in the direction of the substrate.

Another possibility by which the slotted plate 28 becomes superfluous as an isolated part is if the recesses 33 were incorporated into a surface 39 of the front plate 29 facing the conjoining plate 27, so that slot jets S would likewise also be formed, once the front plate 29 and the conjoining plate 27 were assembled.

Figure 5:
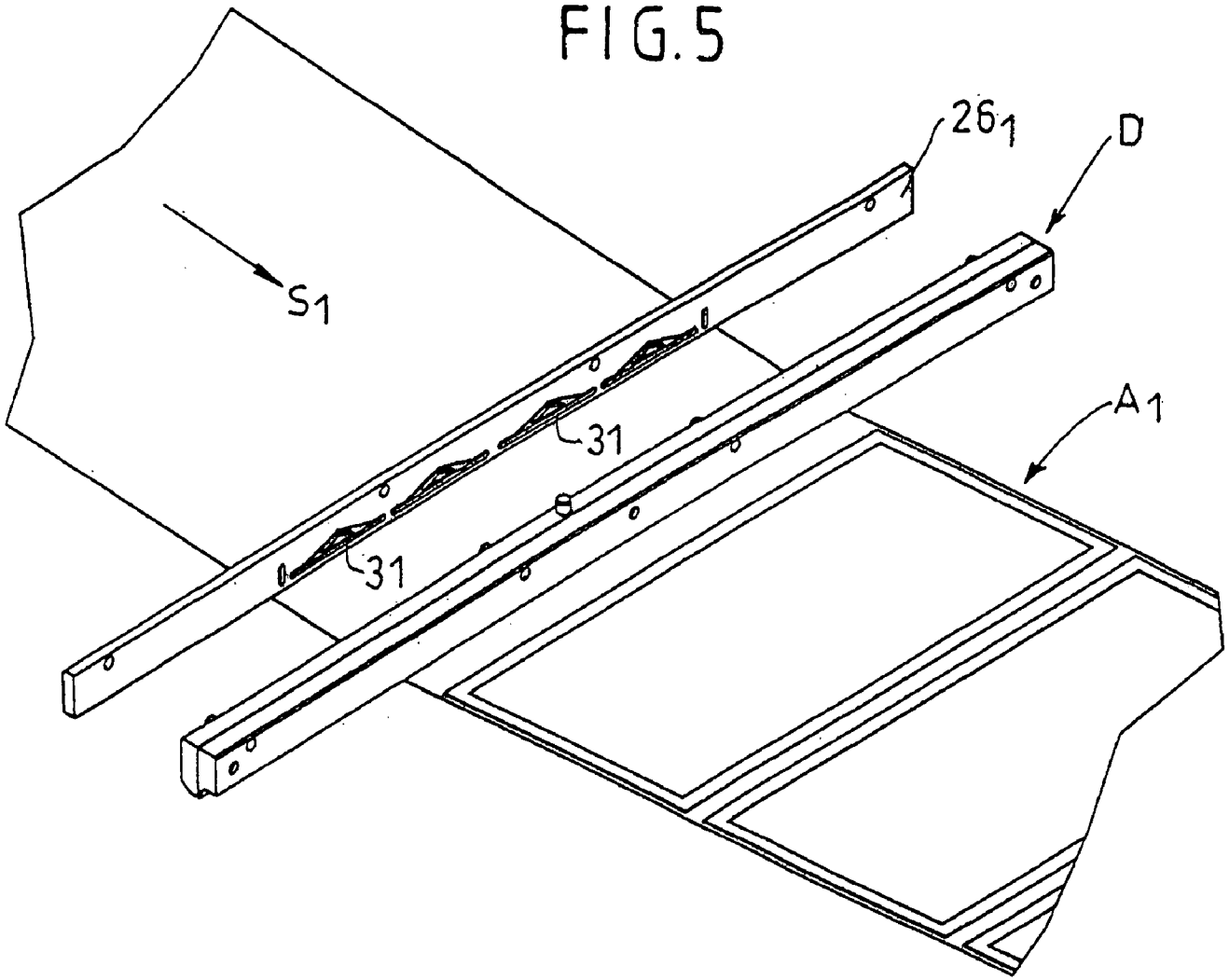
Figure 6:
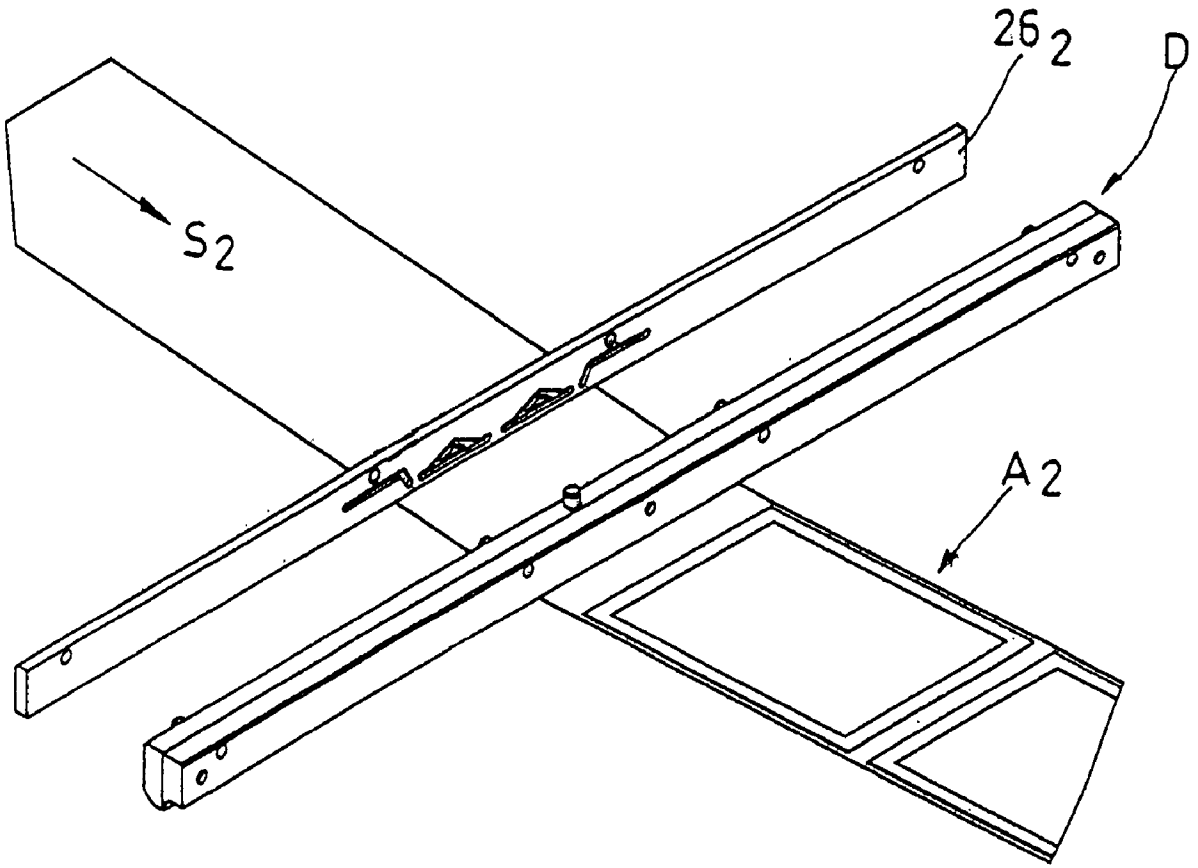

In FIG. 5 and FIG. 6 the illustrations of different application patterns $A_1$ and $A_2$ on all substrates $S_1$ and $S_2$ are, for example, recognizable. It concerns the window application patterns $A_1$ and $A_2$, which are each formed using an identical jet strip system D and variously formed distribution plates $\mathbf{26}_1$ and $\mathbf{26}_2$.

The invention claimed is:

1. A mechanism for applying at least a viscous substance onto a moving substrate, said mechanism comprising:

a body;

a plurality of application modules disposed on said body;

at least one supply unit for supplying the viscous substance to said plurality of application modules; and a slot jet configurator for applying the viscous substance onto the moving substrate in an application pattern, said slot jet configurator comprising:

a jet strip system usable for any application pattern; and a distribution plate replaceable to change the application pattern and positioned upstream of the jet strip system;

wherein the jet strip system comprises a slotted plate having recesses facing down towards a moving path of the substrate; and a conjoining plate which is positioned between the plurality of application modules and said slotted plate and which has notches corresponding to the recesses of the slotted plate.

2. The mechanism in accordance with claim 1, wherein the distribution plate is placed further away from the moving path of the substrate than said jet strip system.

3. The mechanism in accordance with claim 1, wherein the recesses of the slotted plate are formed as cavities which extend towards the moving path of the substrate, and which define together with the notches of the conjoining plate a slot jet configuration.

4. The mechanism in accordance with claim 1, wherein the jet strip system further comprising a front plate, and the recesses of the slotted plate are covered by the front plate on the side facing away from the conjoining plate.

5. The mechanism in accordance with claim 4, wherein the slotted plate, the conjoining plate and the front plate of the jet strip system are fastened together.

6. The mechanism in accordance with claim 4, further comprising a plurality of positioning pivots and connecting screws for positioning and fastening the slotted plate, the conjoining plate and the front plate of the jet strip system together.

7. The mechanism in accordance with claim 6, wherein the positioning pivots extend out of the jet strip system, towards the plurality of application modules, and into respective drill holes in the distribution plate for positioning the distribution plate on the jet strip system.

8. A mechanism for applying at least a viscous substance onto a moving substrate, said mechanism comprising:

a body;

a plurality of application modules disposed on said body;

at least one supply unit for supplying the viscous substance to said application modules; and a slot jet configurator for applying the viscous substance onto the moving substrate in an application pattern, said slot jet configurator comprising:

a jet strip system usable for any application pattern; and a distribution plate replaceable to change the application pattern and positioned upstream of the jet strip system;

wherein the jet strip system and the distribution plate are attachable by means of a pressure plate on the body.

9. The mechanism in accordance with claim 8, further comprising a number of assembly screws and pressure screws, wherein the assembly screws serve to fix the pressure plate to the body at a distance and the pressure screws are adapted to attach the jet strip system and the distribution plate between the body and the pressure plate.

10. A mechanism for applying a substance onto a moving substrate, said mechanism comprising:

a body;

at least one application module disposed on said body and defining together with said body a passage for the substance;

at least one supply unit connected to said at least one application module for supplying the substance to said passage; and a slot jet configurator comprising:

a jet strip system having a plurality of orifices facing downward toward a moving path of said substrate; and a distribution plate positioned between said body and said let strip system and providing fluid communication between said passage and selected ones of said plurality of orifices for applying the substance from the selected orifices onto the substrate in a predetermined application pattern;

wherein said jet strip system is usable for any application pattern and said distribution plate is replaceable independently of the jet strip system for charging the application pattern; and wherein the jet strip system comprises a slotted plate having recesses facing downward toward the moving path of the substrate; and a conjoining plate which is positioned between the distribution plate and said slotted plate and which has notches corresponding to the recesses of the slotted plate and defining together with said recesses the orifices of said jet strip system.

11. The mechanism in accordance with claim 10, wherein the distribution plate is placed further away from the moving path of the substrate than said jet strip system.

12. The mechanism in accordance with claim 10, wherein the recesses of the slotted plate are formed as cavities which extend towards the moving path of the substrate.

13. The mechanism in accordance with claim 10, wherein the jet strip system further comprising a front plate, and the recesses of the slotted plate are covered by the front plate on the side facing away from the conjoining plate.

14. The mechanism in accordance with claim 10, wherein the slotted plate and the conjoining plate of the jet strip system are fastened together by a fastening element, and the distribution plate is not fastened to said jet strip system by said fastening element.

15. The mechanism in accordance with claim 14, wherein said fastening element comprises at least one positioning pivot and at least one connecting screw for positioning and fastening the slotted plate and the conjoining plate of the jet strip system together.

16. The mechanism in accordance with claim 17, wherein said at least one positioning pivot extends out of the jet strip system, towards the body, and into a respective hole in the distribution plate for positioning the distribution plate on the jet strip system.

17. The mechanism in accordance wit claim 10, further comprising a pressing member, wherein the jet strip system and the distribution plate are attached on the body by means of said pressing member.

18. The mechanism in accordance with claim 17, further comprising at least one assembly screw and at least one pressure screw, wherein the at least one assembly screw fixed the pressing member to the body with a gap therebetween; and said distribution plate and jet strip system are positioned in said gap, and are pressed against said body by said at least one pressure screw.

19. The mechanism in accordance with claim 18, wherein said pressing member comprises a hole through which said pressure screw extends.

* * * * *